US005542179A

United States Patent [19]

Beutel

[11] Patent Number: 5,542,179

[45] Date of Patent: Aug. 6, 1996

[54] DRY SHAVING APPARATUS WITH OUTER CUTTER FRAME LOCKING MEANS

[75] Inventor: Kurt Beutel, Flörsheim, Germany

[73] Assignee: Braun Aktiengesellschaft, Kronberg, Germany

[21] Appl. No.: 404,914

[22] Filed: Mar. 16, 1995

[30] Foreign Application Priority Data

Mar. 26, 1994 [DE] Germany ..... 44 10 543.6

[51] Int. Cl.[6] ..... B26B 19/38

[52] U.S. Cl. ..... 030/043.92; 030/043

[58] Field of Search ..... 030/43.9, 43.92, 030/43

[56] References Cited

U.S. PATENT DOCUMENTS

| | | | |
|---|---|---|---|
| 3,590,482 | 7/1971 | Carr | 30/43.9 X |
| 3,997,969 | 12/1976 | Czerner et al. | 30/43.92 |
| 4,606,122 | 8/1986 | Ullmann et al. | 30/43.92 |
| 4,926,552 | 5/1990 | Otsuka et al. | 30/43.92 |
| 4,991,295 | 2/1991 | Messinger | 30/43.92 |
| 5,163,227 | 11/1992 | Wolf et al. | 30/43.92 |

FOREIGN PATENT DOCUMENTS

| | | |
|---|---|---|
| 0320535 | 6/1989 | European Pat. Off. . |
| 2271004 | 5/1975 | France . |
| 2271005 | 5/1975 | France . |
| 4029377 | 8/1991 | Germany . |

*Primary Examiner*—Hwei-Siu Payer
*Attorney, Agent, or Firm*—Fish & Richardson, P.C.

[57] ABSTRACT

The invention is directed to a dry shaving apparatus, with a housing portion (21) provided on the housing (1) in which at least two latch elements (29) are arranged, with at least one spring (31) as well as with a frame (20) carrying at least one outer cutter (18) and providing at least two coupling elements (28). For controlling the latch elements (29), at least one slidably arranged control member is provided.

19 Claims, 7 Drawing Sheets

DRY SHAVING APPARATUS WITH OUTER CUTTER FRAME LOCKING MEANS

This invention relates to a dry shaving apparatus, with a housing portion provided on the housing in which at least two latch elements and at least one spring are arranged, as well as with a frame carrying at least one outer cutter and providing at least two coupling elements for engagement with the latch elements.

A dry shaving apparatus of the type initially referred to is known from DE 40 29 377 C1. This dry shaving apparatus is equipped with four latch elements, for example, of which one is shown in FIG. 1 by way of example. The latch elements engage in recesses formed on the inside of the two longitudinally extending end walls of the frame carrying at least one outer cutter. For reasons of manufacture, different locking forces result which retain the latch elements in the corresponding recesses on the outer cutter frame, in consequence of which disengagement of the outer cutter frame from the housing portion for the purpose of, for example, cleaning the inner cutter, occurs with either too much ease or too much difficulty.

When detaching the outer cutter frame from the housing portion, the risks exists for the user to exert such a high pressure on the longitudinally extending end walls of the outer cutter frame to overcome the locking forces that breakage of the frame occurs after it is unseated from the housing portion.

From DE 34 15 122 a dry shaving apparatus is known having a movable inner cutter and an outer cutter which cooperates with the inner cutter and is attached in an auxiliary frame providing in either end thereof a resilient detent means which engages with a corresponding notch provided in the respective end cheek of the shaver housing and is actuatable by respective resilient unlocking buttons arranged in the end cheeks for the purpose of removing the auxiliary frame with its outer cutter from the shaver housing.

It is an object of the present invention to improve the locking engagement of a frame carrying at least one outer cutter with a housing portion of the dry shaving apparatus.

This object is accomplished according to the present invention in that, for controlling the latch elements, at least one control member is provided which is slidable parallel to the axis x—x against the pressure of the at least one spring, with the latch elements being movable in the housing portion in a direction transverse to the axis x—x and being displaceable by the control member in opposition to the pressure of the spring acting on the latch elements.

It is an essential advantage of the present invention that the control member slidably arranged in the housing portion is capable of controlling the motion of all latch elements engaging with coupling elements into an unlocked position, thus enabling the user to detach the frame carrying at least one outer cutter readily without the need to exert an unlocking pressure on the frame.

In an embodiment of the present invention, at least two latch elements are provided on each control member.

In a preferred embodiment of the present invention, the latch elements with the control member are controllable by means of control cams engaging within control grooves.

In a further feature of this embodiment, the latch elements are provided with control grooves extending at an angle of inclination to the direction of movement of the control member. Preferably, the control cams are provided on the control member.

This embodiment of the present invention which is of a very straightforward construction thus affording manufacture at low cost ensures, by means of the inclined arrangement of the control grooves provided in the latch elements and the control cams provided on the control member, that all latch elements are at the same time moved into an unlocked position against the pressure of a spring, thereby releasing the frame carrying an outer cutter. As the user releases the control member, the control member is relieved of pressure, as a result of which the springs acting on the latch elements return the latch elements and the control member into an initial position corresponding to the locked position. This is a secondary function of the springs acting on the latch elements, their primary function being to produce the retaining or locking force by means of which the frame carrying the outer cutter is held on the housing portion.

The object identified in the foregoing is further solved in that, for controlling the latch elements, at least one control member is provided which is slidable parallel to the axis x—x against the pressure of the at least one spring, with the latch elements being fixedly disposed on the control member and being displaceable with the control member against the pressure of a spring acting on the control member.

Preferably, the spring rests with one end against the control member and with its other end against an end cheek or an end wall or a leg of the housing portion. This embodiment of the present invention ensures an optimum locking and unlocking action of a frame carrying an outer cutter to and from a housing portion of the dry shaving apparatus using few components.

In all embodiments of the present invention, the coupling elements and the latch elements are preferably provided with slanting surfaces. In one embodiment of the present invention, the spring-loaded latch elements with their slanting surfaces are urged into engagement with corresponding slanting surfaces of the coupling elements provided in the frame. Through these slanting surfaces, force components are produced urging the frame into firm seating engagement with the housing portion. By suitably dimensioning the angle of the slanting surfaces relative to a coordinate plane, it is possible to influence or configure advantageously the force components of the retaining forces or the disengagement forces of the frame from the housing portion. By means of the latch elements each of which is spring-mounted by its own spring, and by means of the slanting surfaces on the latch elements and on the coupling elements, this locking arrangement is particularly suited to compensate for manufacturing tolerances. , In a further feature of the present invention, at least one actuating member is provided for actuation of the control member.

In another embodiment of the present invention, one actuating member is provided on the control member, this actuating member being associated with a further actuating member. In such an embodiment, the further actuating member is resiliently arranged in at least one of the support lugs or in at least one of the end cheeks of the housing portion.

In a still further embodiment of the present invention, two control members are arranged in the housing portion so as to be movable against the pressure of at least one spring. In a further feature of this embodiment, two latch elements and one actuating member are provided on each of the control members. In this embodiment of the present invention, the actuating force to be exerted for disengaging the frame from its locked position on the housing portion is split on two actuating members which are adapted to be acted upon, either indirectly or directly by direct finger pressure, by further actuating members resiliently mounted in support lugs or end cheeks of the housing portion. This embodiment of the present invention allows an actuation that is neutral in respect of the forces applied, because unlocking a frame with its outer cutter from a housing portion requires the simultaneous actuation of two control members in opposite directions against the pressure of a spring, in addition to affording ease of operation because the spring forces of the springs acting indirectly or directly on the latch elements can be reduced. In an embodiment of the present invention, the housing portion is configured as a part formed fast with the housing.

In still another embodiment of the present invention, the housing portion is movably arranged on the housing between two support lugs or end cheeks.

Some embodiments of the present invention will be described in the following with reference to the accompanying drawings, in which.

Figure 1:
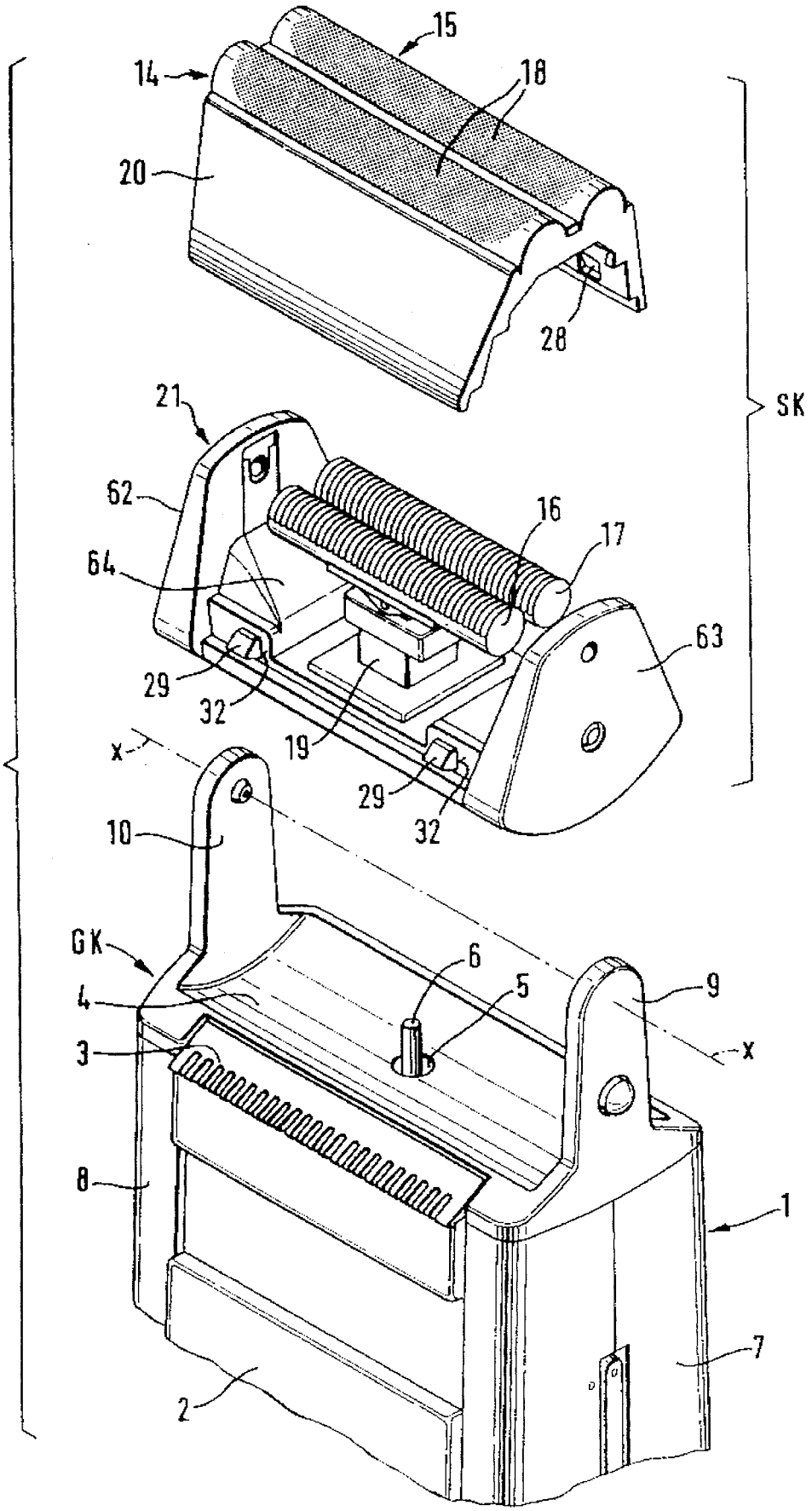
FIG. 1 is a perspective view of the upper portion of a dry shaving apparatus, showing the shaving head assembly in detached position.

Referring now to FIG. 1 showing the upper portion of a dry shaving apparatus, reference numeral 1 identifies a housing, reference numeral 2 an On/Off switch, 3 a long-hair trimmer assembly, 4 a housing upper end, 6 a drive pin extending out of an opening 5 in the housing upper end 4, numerals 9 and 10 designate support lugs forming an extension of respective narrow sides 7 and 8 of the housing, and SK identifies a shaving head assembly pivotally mounted about an axis x—x by means of bearing screws 11. The support lugs 9, 10 form a constituent part of a plastic head portion GK of the housing as shown in FIG. 1, or are integrally formed with the housing 1, as shown in FIG. 2.

The shaving head assembly SK shows a pair of parallel shaving heads 14 and 15 comprising two inner cutters 16 and 17 as well as outer cutters 18 fitted over the inner cutters 16 and 17 in arched form. The inner cutters 16 and 17 are resiliently mounted on a common connecting member 19. The connecting member 19 is connected to a drive member 47 forming a constituent part of an oscillating bridge structure 61 carried in the housing portion 21—see FIG. 2. For transmitting the driving motion from the drive pin 6 to the oscillating bridge structure 61, the latter is provided with two transverse rib members 22 and 23 having a space 24 therebetween for engagement by the drive pin 6. When the drive is activated, the transverse rib members 22 and 23 of the oscillating bridge structure 61 oscillate within an opening 26 provided in a bottom plate 27 in the housing portion 21 of the shaving head frame.

Figure 2:
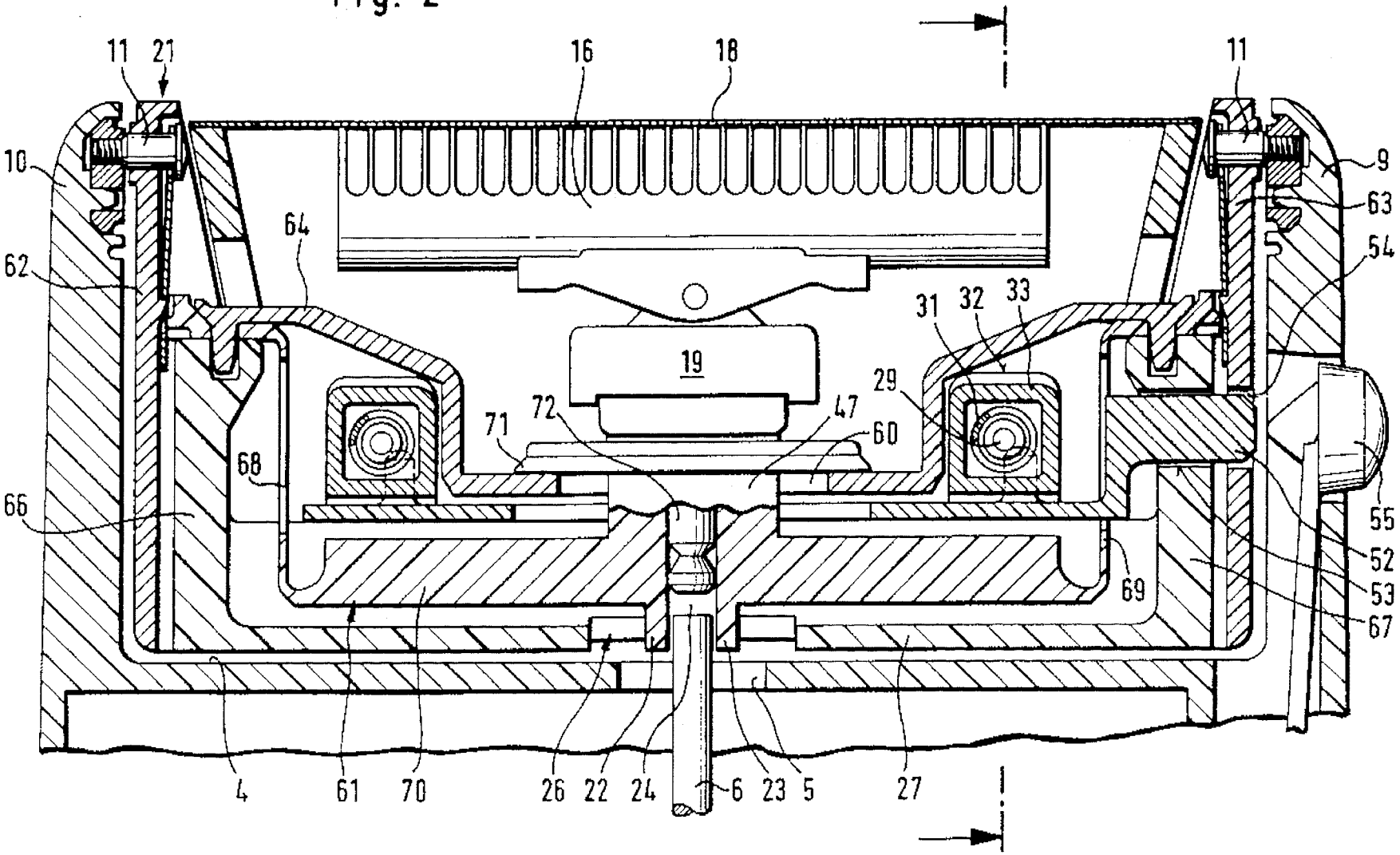
FIG. 2 is a longitudinal sectional view of the shaving head assembly of FIG. 1.

By analogy with FIG. 1, in FIG. 2 the housing is assigned reference numeral 1, the support lugs made of a plastics material and integrally formed with the housing carry the numerals 9 and 10, and reference numeral 6 denotes the drive pin which extends out of the opening 5 in the housing upper end 4 into the space 24 between the transverse rib members 22 and 23 provided on the oscillating bridge member 61. The housing portion 21 made of a plastics material of which in FIG. 2 the end walls 62, 63 and the inner wall 64 extending into the interior space are shown, is pivotally mounted on the support lugs 9 and 10 by means of bearing screws 11. The plastic bottom plate 27 of the housing portion 21 is of a U-shaped configuration. The bottom plate 27 is provided with legs 66, 67 extending parallel to the end walls 62, 63 of the housing portion 21. Secured to the upper ends of the legs 66, 67 is the oscillating bridge structure 61 which is comprised of two depending spring arms 68, 69 and a plate 70 connecting the spring arms 68, 69. The bottom plate 27 has an opening 26 into which the transverse rib members 22, 23 of the oscillating bridge structure 61 extend to be connected to the drive pin 6. The drive member 47 serving to provide a connection to the bearing pin 72 of the connecting member 19 is integrally formed with the plate 70, thus forming a constituent part of the oscillating bridge structure 61. A seal 71 closes an opening 60 provided in the inner wall 64 of the housing portion 21.

For releasably securing the frame 20 carrying at least one outer cutter 18, the frame includes recesses 28 for engagement with latch elements 29 resiliently mounted in the housing portion 21, with at least two latch elements 29 with their corresponding recesses 28 in the frame 20 being provided for the purpose of securely fastening the frame 20 on the housing portion 21.

In the embodiment of FIG. 1 which will be explained in greater detail with reference to FIGS. 2 to 7, four latch elements, for example, are movably arranged in the inner wall 64 of the housing portion 21 in a direction transverse to the direction in which the axis x—x extends, with a spring 31—see FIGS. 3 to 7—being disposed between two oppositely mounted latch elements 29 each.

Figure 3:
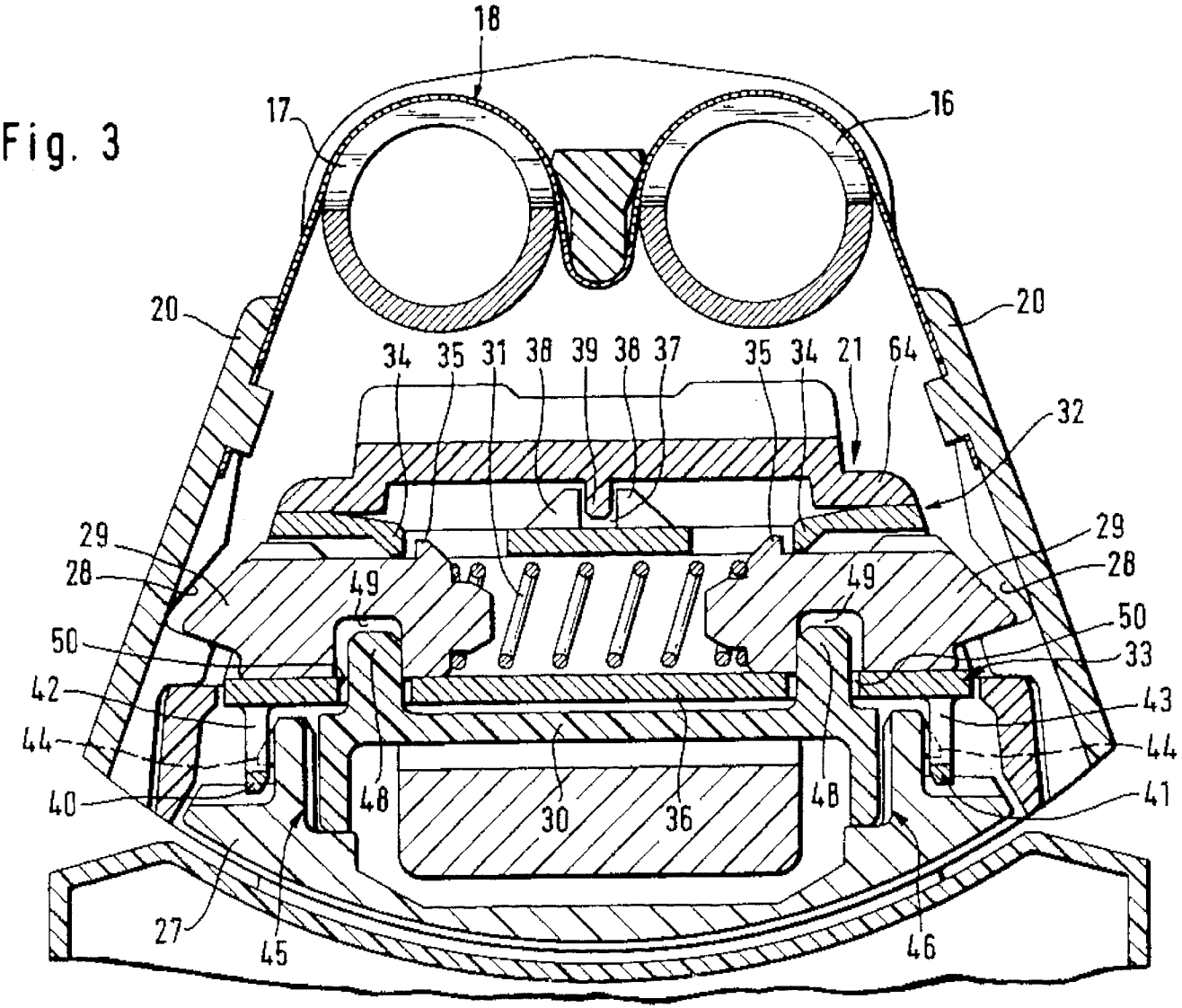
FIG. 3 is a cross-sectional view of the shaving head assembly of FIG. 1 or FIG. 2, taken in the area of latch elements.

To mount the latch elements 29, openings 32 are provided in the inner wall 64 of the housing portion 21, in which openings the latch elements 29 are either directly slidably guided—see FIGS. 4 to 7—or, with the aid of supporting members 33 facilitating the mounting, holding and guiding of the latch elements 29, are arranged so as to protrude from the openings 32—see FIG. 2 and FIG. 3. In addition, the supporting members 33 allow a prior assembly of latch subassemblies comprised of one supporting member 33 and two latch elements 29 movably guided in the supporting members 33 in opposition to the pressure of a spring 31, with the movability of the latch elements out of the supporting member 33 being limited by means of cooperating stop members 34, 35 provided on the supporting member 33 and on the latch elements 29.

Formed on the outer wall 36 of the supporting member 33 on the side close to the bottom plate 27 are two retaining members 40, 41 having openings 42, 43 into which detent means 44 provided on the bottom plate 27 engage in order to connect the supporting members 33 carrying the spring 31 and the latch elements 29 to the bottom plate 27.

Extending parallel to the axis x—x on the inside of the bottom plate 27 are two stepped shoulders 45, 46 for slidably guiding a control member 30 provided with control cams 48. The control cams 48 extend through openings 50 provided in the outer wall 36 of the supporting members 33 and are in engagement with control grooves 49 provided in the latch elements 29. Following connection of the supporting members 33 to the bottom plate 27 by means of the retaining members 40, 41 and the detent means 44, the control member 30 is slidably held or guided on the stepped shoulders 45, 46. On the outer wall 36 of the supporting member 33 opposite the retaining members 40, 41, two retaining members 38 having inclined side walls are provided at a predetermined relative distance for the purpose of forming a retaining groove 37. By means of a retaining member 39 provided on the inner wall 64 and engaging within the retaining groove 37 by engagement of the inner wall 64 with the bottom plate 27, the supporting members 33 provided are immovably held or fixed in place in the housing portion 21.

Figure 4:
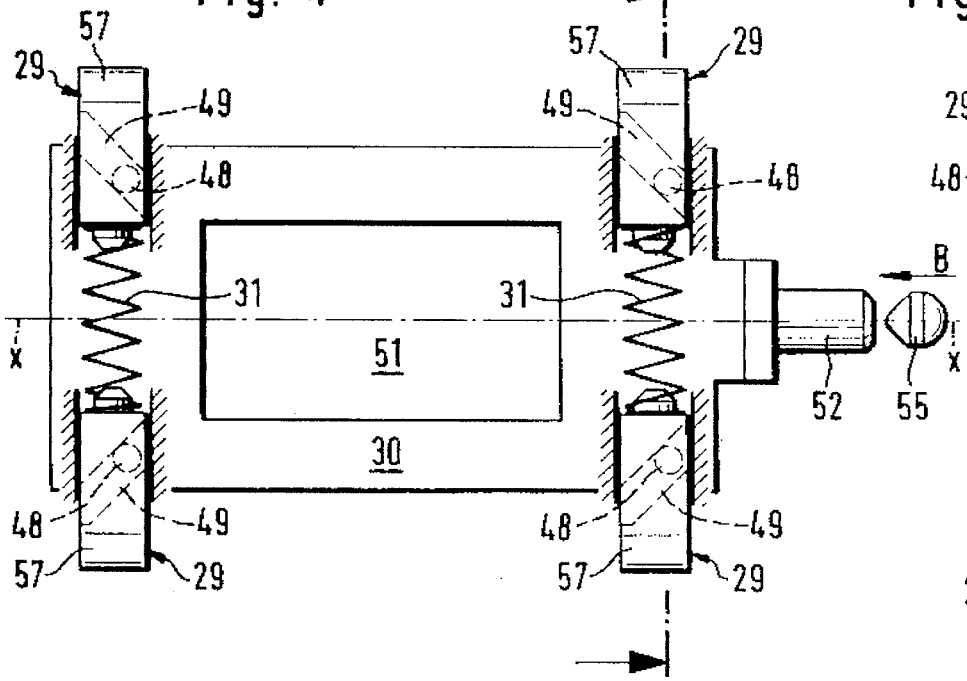
FIGS. 4 to 7 are schematic views showing the cooperative relationship between latch elements and one control member and one actuating member.
Figure 5:
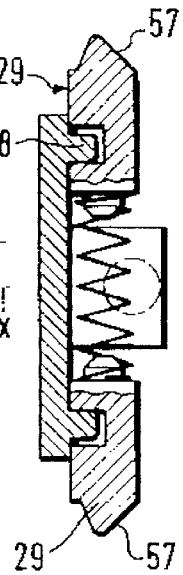
Figure 6:
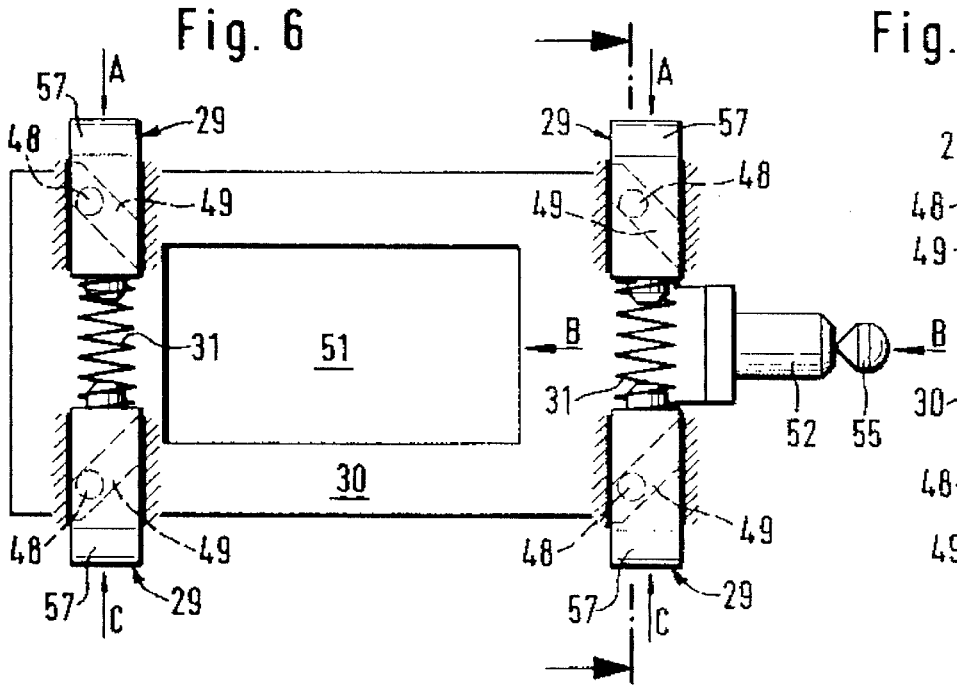
Figure 7:
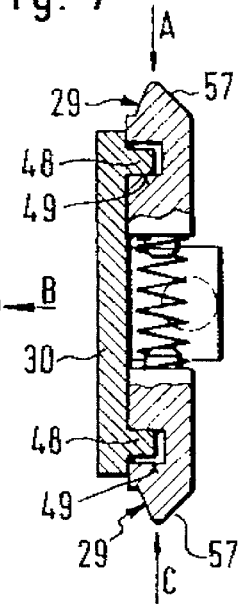

FIG. 4 is a schematic view of the control member 30 as well as of four latch elements 29 coupled to the control member 30 by means of control grooves 49 and control cams 48. The control grooves in the latch elements 29 extend at an angle of inclination of about 45 degrees to an axis x—x, such that on the application of a pressure on the actuating member 52 in the direction of arrow B, the control cams 48 act on one of the inclined side walls of the control grooves 49, thus displacing the latch elements 29 against the pressure of the spring 31 disposed between two opposite latch elements 29 each in the respective directions of the arrows A and C transversely to the axis x—x.

The actuating member 52 provided on the control member 30 extends through an opening 53 provided in the leg 67 of the bottom plate 27, protruding into a further opening 54 provided in the end wall 63. In the support lug 9 an actuating member 55, for example, is resiliently mounted such that the application of pressure on the actuating member 55 causes a displacement of the control member 30 in the direction of arrow B through the actuating member 52, whereby the control cams 48 provided on the control member act on the inclined walls of the control grooves 49, and the opposite latch elements 29 move in opposite directions, as indicated by the arrows A and C, against the pressure of the spring 31. This sequence of motions of the latch elements 29 is illustrated in FIGS. 4 to 7. As a result of the motion of the latch elements 29 transverse to the axis x—x as caused by the actuation of the control member 30, the latch elements 29 become disengaged from the coupling elements 28 configured as recesses in the frame 20, so that the frame 20 carrying the outer cutter(s) 18 is unlocked from the housing portion 21 and consequently can be detached therefrom. The opening 51 provided in the control member 30 serves as a passageway for drive elements and connecting elements from the drive pin 6 to the inner cutters 16, 17—see FIG. 2.

Figure 8:
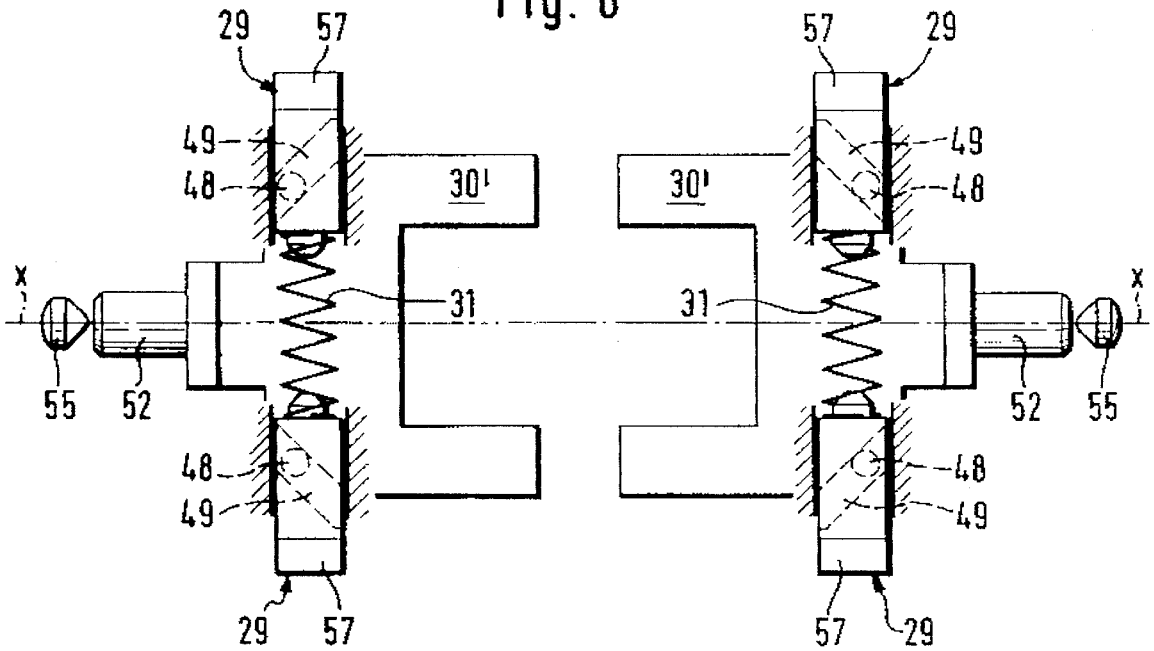
FIGS. 8 and 9 are schematic views showing the cooperative relationship between two control members and latch elements associated therewith and actuating members.
Figure 9:
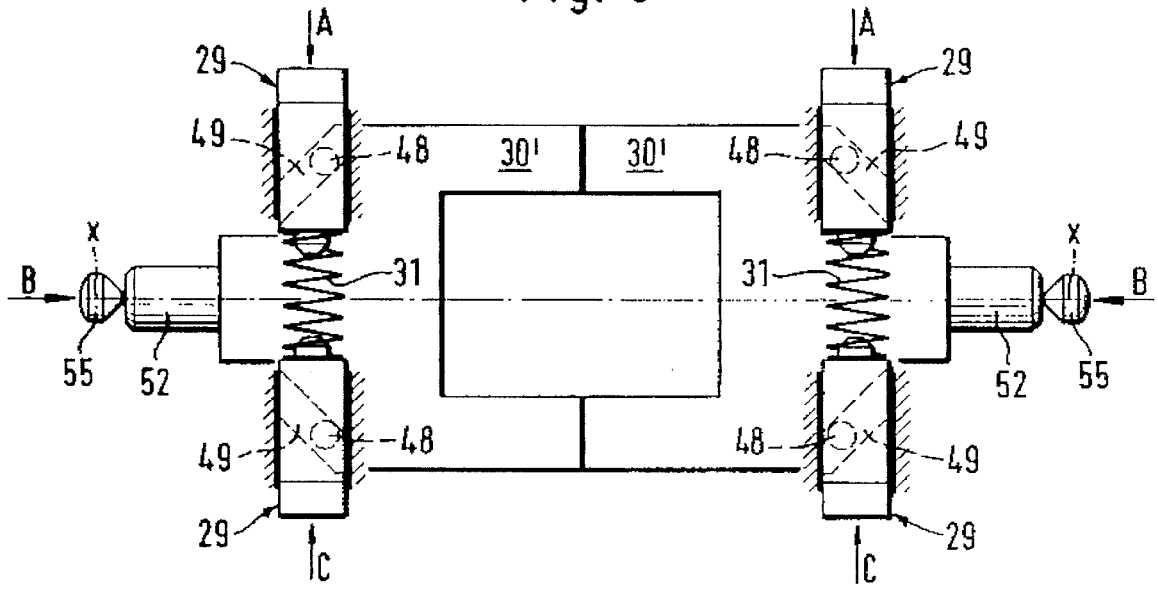

The embodiment of FIGS. 8 and 9 shows by way of example two congruent control members 30' which may be movably arranged in a housing portion 21 as an alternative to a single-piece control member 30—as in FIG. 4, for example. Each of the two control members 30' includes an actuating member 52 adapted to be acted upon by a respective actuating member 55 arranged in the support lugs 8 and 9—see FIG. 2. On actuation of the actuating member 55, these act first on the actuating members 52, thus causing the control members 30' to move towards each other. As this occurs, the control cams 48 of the control members 30' engaging the control grooves 49 move two respective latch elements 29 against the pressure of a spring 31 arranged between two latch elements in the directions indicated by respective arrows A and C transversely to the axis x—x, as a result of which the latch elements 29 become disengaged from the coupling elements 28 configured as recesses in the frame 20, releasing the frame 20 for detachment from the housing portion 21. Following detachment of the frame 20 and subsequent release of the actuating members 52 and/or 55, the springs 31 return the respective control members 30' into an initial position corresponding to the locked position—see FIG. 8. The previously described locking and unlocking action of four latch elements 29 with and from four corresponding coupling elements 28 provided in a frame 20 may also be accomplished by the use and the arrangement of only one spring 31 in lieu of two springs 31 according to FIGS. 8 and 9. Where only one spring 31 is provided, this spring 31 would have to be arranged between the two control members 30' movable in relatively opposite directions— not shown.

Figure 11:
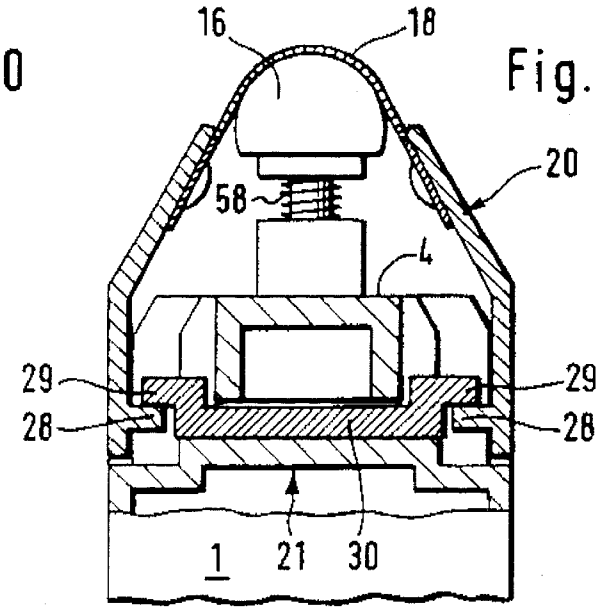
FIG. 11 is a cross-sectional view of the dry shaving apparatus of FIG. 10, having one control member and latch elements.
Figure 10:
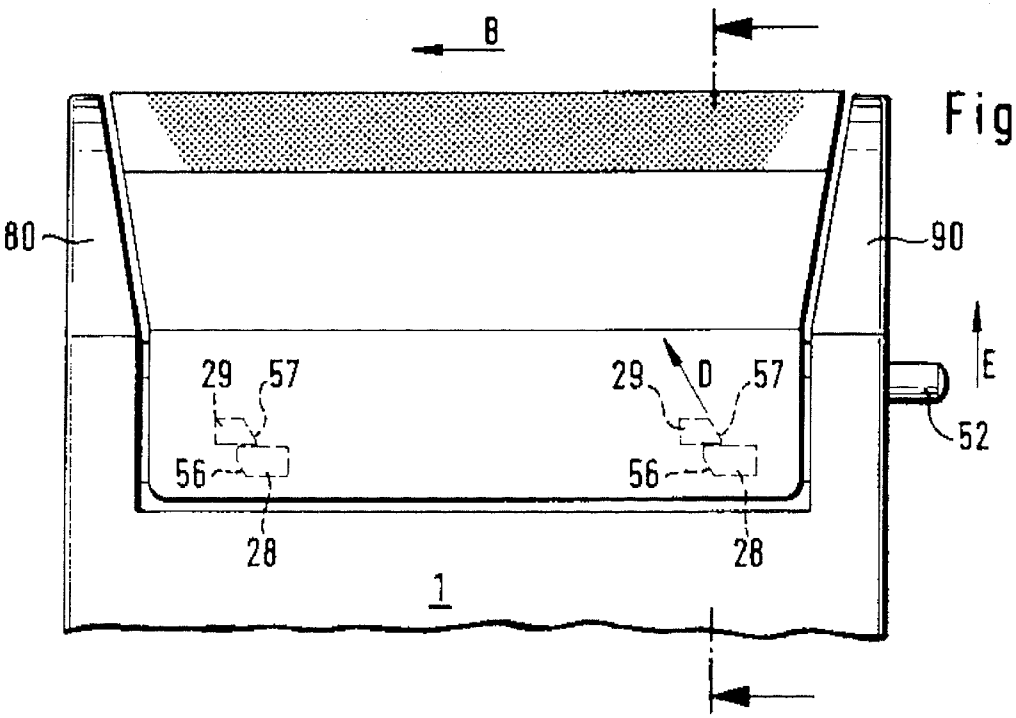
FIG. 10 is a view of the upper portion of a dry shaving apparatus having an outer cutter and a frame carrying the outer cutter.
Figure 12:
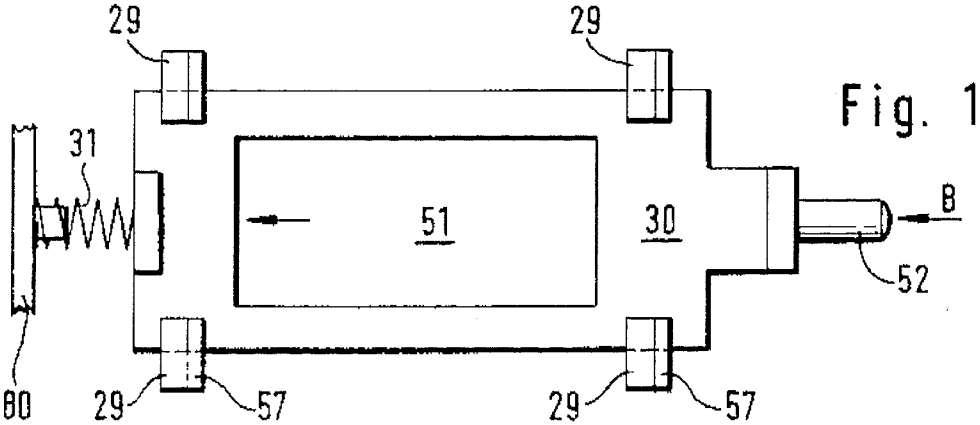
FIG. 12 is a top plan view of a control member with latch elements and a spring means.

In the embodiment of FIG. 10 and FIG. 11, the housing 1 of the dry shaving apparatus includes two end cheeks 80 and 90 between which the frame 20 carrying an outer cutter 18 is detachably arranged. For releasably securing the frame 20, latch elements 29 movable against the pressure of a spring 31 are provided in the upper housing portion 21 of the housing 1, cooperating with coupling elements 28 provided on the frame 20. The latch elements 29 are part of a control member 30 movably mounted in the housing portion 21. The control member further includes an actuating member 52 extending, for example, through the end cheek 90 and capable of being actuated directly by the user for the purpose of unlocking the frame 20 carrying an outer cutter 18. At the end of the control member 30 opposite the actuating member 52, the housing portion 21 receives the spring 31 bearing with one end against the control member 30 while its other end takes support upon a component of the housing portion 21 as, for example, the end cheek 80. Slanting surfaces 56 and 57—extending in the direction of arrow D—are provided on the coupling elements 28 and on the latch elements 29, respectively, such that a displacement of the control member 30 in the direction of arrow B against the pressure of the spring 31 cancels the locked position, such that the coupling elements 28 with their slanting surfaces 56 on the frame 20 are moved past the slanting surfaces 57 of the latch elements 29 as the frame 20 is detached. Detachment of the frame 20 carrying the outer cutter 18 in the direction of arrow E is supported, after release of the coupling elements 28, by the pressure of the spring 58 urging the inner cutter 16 into engagement with the outer cutter 18. During the coupling engagement of the frame 20 with the housing portion 21, the slanting surfaces 56 of the coupling elements 28 facilitate the locking engagement of the housing portion 21 with the frame 20 in that the slanting surfaces 56 slide along the slanting surfaces 57 of the latch elements 29. As this action proceeds, the coupling elements 28 configured in cam shape urge the control member 30 through the latch elements 29 in the direction of arrow B against the pressure of the spring 31 until, after traveling over the slanting surfaces 57 of the latch elements 29, the control member 30 with the latch elements 29 is automatically moved into the locked position by release of the spring 31, as shown in FIG. 10 and FIG. 11.

Figure 14:
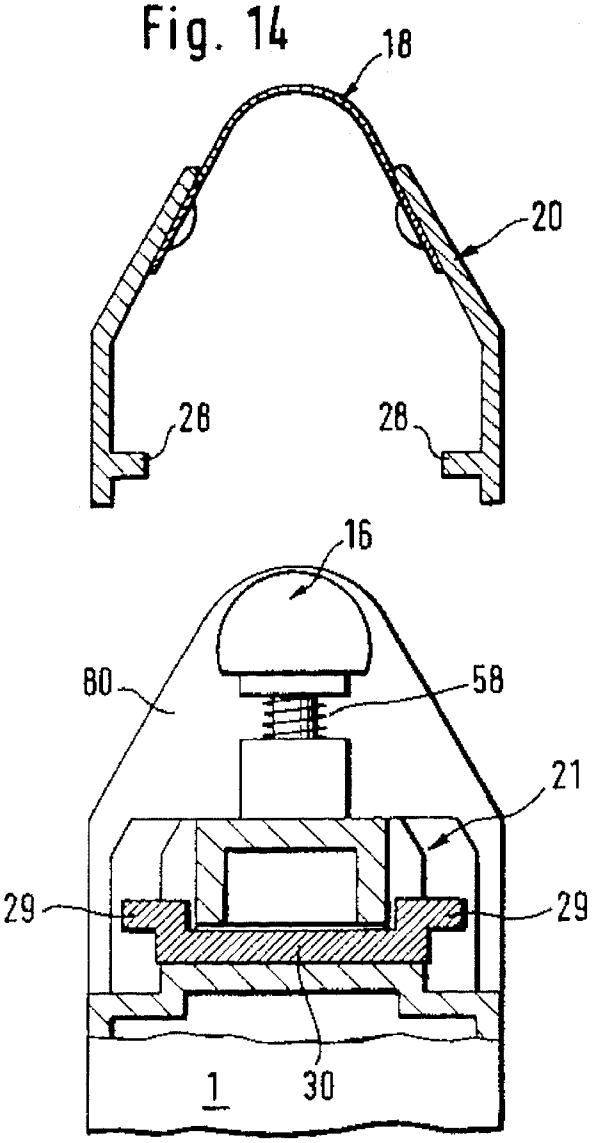
FIG. 14 is a cross-sectional view of the upper portion of the dry shaving apparatus as well as of the detached frame of FIG. 13.
Figure 13:
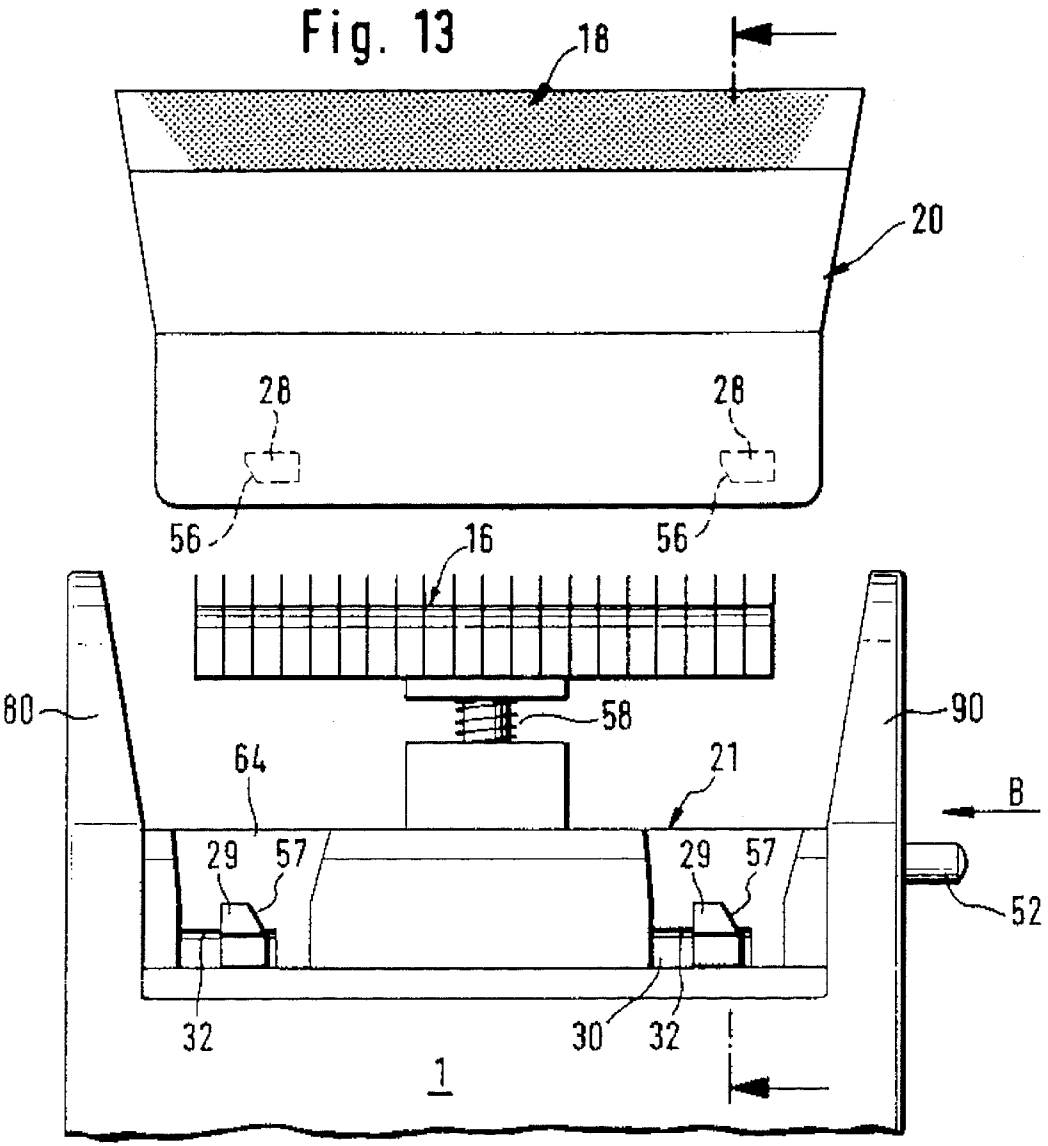
FIG. 13 is a view of the upper portion of a dry shaving apparatus of FIG. 10, showing the frame in detached position.

FIG. 13 and FIG. 14 show a frame 20 with an outer cutter 18 secured thereto in detached condition from the upper housing portion 21 of the housing 1. Formed on the inside of the side walls of the frame 20 are coupling elements 28 having slanting surfaces 56 extending each in the same direction—see cross-sectional view of FIG. 14. The housing portion 21 of the housing 1 includes a detachably arranged inner wall 64 in which openings 32 are provided for passage of the latch elements 29 movable with the control member 30 against the pressure of a spring 31 in the direction of arrow B, the latch elements cooperating with the coupling elements 28 to effect a coupling and decoupling action of the frame 20 to and, respectively, from the upper housing portion 21 of the dry shaving apparatus, with the slanting surfaces 57 facilitating the coupling engagement of the frame 20 by sliding along the slanting surfaces 56 provided on the coupling elements 28.

I claim:

1. A dry shaving apparatus comprising:

a housing, a housing portion having two latch elements and a spring, a frame carrying an outer cutter two coupling elements which engage the latch elements, and a control member controlling the latch elements, the control member being slidably moveable in a direction parallel to an axis x—x against the pressure of the spring, with the latch elements being movable in the housing portion in a direction transverse to the axis x—x and being displaceable by the control member in opposition to the pressure of the spring acting on the latch elements.

2. The dry shaving apparatus as claimed in claim 1, wherein the control member includes control cams and the latch elements include control grooves, the latch elements with the control member being controllable by means of the control cams engaging the control grooves.

3. The dry shaving apparatus as claimed in claim 2, wherein said control grooves extend at an angle of inclination with respect to the direction of slidable movement of the control member.

4. The dry shaving apparatus as claimed in claims 2 or 3, wherein the control cams are formed on the control member.

5. A dry shaving apparatus comprising:

a housing, a housing portion having two latch elements and a spring, a frame carrying an outer cutter and two coupling elements which engage the latch elements, and a control member controlling the latch elements, the control member being slidably moveable in a direction parallel to an axis x—x against the pressure of the spring, with the latch elements being fixedly disposed on the control member and being displaceable with the control member against the pressure of the spring acting on the control member.

6. The dry shaving apparatus as claimed in claim 1 or claim 5, further comprising a second control member, at least two latch elements provided on each control member.

7. The dry shaving apparatus as claimed in claims 1 or 5, wherein the coupling elements and the latch elements are provided with slanting surfaces.

8. The dry shaving apparatus as claimed in claims 1 or 5, further comprising a first actuating member to actuate the control member.

9. The dry shaving apparatus as claimed in claim 8, further comprising a second actuating member, the first actuating member provided on the control member, said second actuating member contacting said first actuating member to actuate the control member.

10. The dry shaving apparatus as claimed in claim 9, wherein the housing portion further includes support lugs and the second actuating member is resiliently arranged within the support lugs.

11. The dry shaving apparatus as claimed in claim 9, wherein the housing portion further includes end cheeks and the second actuating member is resiliently arranged within the end cheeks.

12. The dry shaving apparatus as claimed in claims 1 or 5, wherein two control members are arranged in the housing portion so as to be movable against the pressure of the spring.

13. The dry shaving apparatus as claimed in claim 12, wherein two latch elements and one actuating member are provided on each of the control members.

14. The dry shaving apparatus as claimed in claims 1 or 5, wherein the housing includes two support lugs and the housing portion is movably arranged on the housing between the two support lugs.

15. The dry shaving apparatus as claimed in 1 or 5, wherein the housing portion is configured as a part fixedly attached to the housing.

16. The dry shaving apparatus as claimed in claims 1 or 5, wherein the housing includes end cheeks and the housing portion is movably arranged on the housing between the end cheeks.

17. The dry shaving apparatus as claimed in claim 5, wherein said housing portion includes an end cheek and the spring rests with one end against the control member and with its other end against the end cheek.

18. The dry shaving apparatus as claimed in claim 5, wherein said housing portion includes an end wall and the spring rests with one end against the control member and with its other end against the end wall.

19. The dry shaving apparatus as claimed in claim 5, wherein said housing portion includes a leg and the spring rests with one end against the control member and with its other end against the leg.

* * * * *